US010548410B2

(12) United States Patent
Creekmuir et al.

(10) Patent No.: US 10,548,410 B2
(45) Date of Patent: Feb. 4, 2020

(54) FIRMNESS CONTROL FOR A SMART RESPONSE TECHNOLOGY BODY SUPPORT

(71) Applicant: DREAMWELL, LTD., Las Vegas, NV (US)

(72) Inventors: William C. Creekmuir, Atlanta, GA (US); Christopher Chunglo, Marietta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 148 days.

(21) Appl. No.: 14/708,444

(22) Filed: May 11, 2015

(65) Prior Publication Data

US 2015/0320230 A1 Nov. 12, 2015

Related U.S. Application Data

(60) Provisional application No. 61/990,818, filed on May 9, 2014.

(51) Int. Cl.

| | |
|---|---|
| ***A47C 27/08*** | (2006.01) |
| ***A47C 27/10*** | (2006.01) |
| ***A47C 27/14*** | (2006.01) |
| ***A61G 7/057*** | (2006.01) |

(52) U.S. Cl.

CPC ..... *A47C 27/081* (2013.01); *A47C 27/088* (2013.01); *A47C 27/10* (2013.01); *A47C 27/146* (2013.01); *A61G 7/05715* (2013.01); *A61G 7/05769* (2013.01)

(58) Field of Classification Search

CPC ..... A47C 27/08; A47C 27/081; A47C 27/082; A47C 27/083; A47C 27/088; A47C 27/10; A47C 27/146; A61G 7/05715; A61G 7/05769; A61G 7/05576; A61G 7/05792; A61G 7/05776

See application file for complete search history.

(56) References Cited

U.S. PATENT DOCUMENTS 4,435,864 A * 3/1984 Callaway ..... A47C 23/047 5/400

4,597,723 A * 7/1986 Sember ..... A47C 7/467 137/883

(Continued)

*Primary Examiner* — David R Hare

(74) *Attorney, Agent, or Firm* — Cantor Colburn LLP

(57) ABSTRACT

Firmness control for a self-adjusting, non-powered smart response technology mattress includes a body support device; one or more layers overlaying the body support device and a side rail assembly circumscribing a perimeter of the body support device; and the firmness control. The body support device includes a plurality of fluid support cells, wherein each fluid support cell includes an envelope and a reforming element disposed within the envelope; and a non-powered manifold system including a manifold conduit fluidly coupled to at least two of the fluid support cells, and intake and exhaust valves fluidly coupled to the manifold conduit configured to dynamically open and close in response to a weight load. The firmness control includes a pressure relief valve fluidly connected to the manifold conduit via a conduit and configured to selectively permit a controlled amount of fluid flow out from the fluid support cells. Also disclosed are processes for adjusting firmness.

13 Claims, 7 Drawing Sheets

(56) References Cited

U.S. PATENT DOCUMENTS 4,679,264 A * 7/1987 Mollura ..... A47C 27/082 417/37
4,797,962 A * 1/1989 Goode ..... A61G 7/05769 417/302
4,915,124 A * 4/1990 Sember, III ..... A47C 7/467 137/223
4,993,920 A * 2/1991 Harkleroad ..... A47C 27/082 417/44.2
5,020,176 A * 6/1991 Dotson ..... A47C 27/082 137/487.5
5,129,115 A * 7/1992 Higgins ..... A47C 27/082 5/713
5,249,319 A * 10/1993 Higgs ..... A47C 27/082 5/713
5,584,085 A * 12/1996 Banko ..... A61G 7/05776 5/710
5,634,224 A * 6/1997 Gates ..... A47C 27/081 5/654
5,649,331 A * 7/1997 Wilkinson ..... A61G 5/1043 297/DIG. 3
5,794,289 A * 8/1998 Wortman ..... A61G 7/001 5/423
6,014,784 A * 1/2000 Taylor ..... A61G 7/05776 297/284.6
6,237,621 B1 * 5/2001 Chaffee ..... A47C 27/081 137/223
6,269,505 B1 * 8/2001 Wilkinson ..... A47C 27/084 5/654
6,332,760 B1 * 12/2001 Chung ..... F04D 25/084 417/239
6,564,411 B2 * 5/2003 Pirzada ..... A47C 4/54 5/709
6,813,790 B2 * 11/2004 Flick ..... A47C 27/082 5/710
6,826,795 B2 12/2004 Wilkinson
6,990,700 B2 * 1/2006 Chung ..... A45B 19/02 137/565.11
7,240,386 B1 * 7/2007 McKay ..... A47C 27/15 5/423
7,434,283 B2 10/2008 Wilkinson et al.
7,617,554 B2 11/2009 Wilkinson
7,886,386 B2 * 2/2011 Balonick ..... A47C 27/082 5/709
8,122,545 B2 2/2012 Wilkinson
8,297,309 B2 * 10/2012 Wang ..... F04D 25/084 137/224
2006/0179579 A1 * 8/2006 Phillips ..... A61G 7/05769 5/713
2008/0028534 A1 * 2/2008 Wilkinson ..... A47C 27/083 5/713
2010/0146709 A1 * 6/2010 Lafleche ..... A61G 7/05715 5/713

* cited by examiner 10
12
14
14
14

FIRMNESS CONTROL FOR A SMART RESPONSE TECHNOLOGY BODY SUPPORT

CROSS REFERENCE TO RELATED APPLICATIONS

This application is a NON-PROVISIONAL of and claims the benefit of U.S. Application No. 61/990,818, filed May 9, 2014, which is incorporated herein by reference in its entirety.

BACKGROUND

The present disclosure generally relates to a firmness control for a non-powered smart response technology body support.

Smart response technology (SRT) body supports such as mattresses are generally non-powered and include a plurality of foam-filled air chambers in the middle of the body support that use a pressure relief valve and a series of intake valves to pass air in and out of the system as weight is applied. The system dynamically adjusts to a person as they move around in bed displacing their weight to provide optimal pressure relief. The principles of SRT are based on Boyles' Law, which makes the system sensitive to temperature and barometric pressure changes. Since every individual end user likely has different definitions of what is too firm or not firm enough, providing effective firmness control to SRT mattresses is desired.

BRIEF SUMMARY

Disclosed herein is a firmness control for a self-adjusting, non-powered smart response technology mattress and process of use. In one embodiment, the self-adjusting, non-powered smart response technology mattress includes a body support device including a plurality of fluid support cells, wherein each fluid support cell includes an envelope and a reforming element disposed within the envelope; and a non-powered manifold system including a manifold conduit fluidly coupled to at least two of the fluid support cells, and intake and exhaust valves fluidly coupled to the manifold conduit configured to dynamically open and close in response to a weight load; one or more layers overlaying the body support device and a side rail assembly circumscribing a perimeter of the body support device; and a firmness control comprising a pressure relief valve fluidly connected to the manifold conduit of the body support device via a conduit and configured to selectively permit a controlled amount of fluid flow out from the fluid support cells in the presence of a weight load so as to adjust a firmness property of the body support.

A process for releasing pressure so as to selectively adjust a firmness level in a self-adjusting, non-powered smart response technology mattress includes adjusting a firmness control in fluid communication with an external environment and a non-powered, self-adjusting body support device, the body support device comprising a plurality of fluid support cells, wherein each fluid support cell includes an envelope and a reforming element disposed within the envelope, a manifold conduit interconnecting at least two of the fluid support cells, and intake and exhaust valves fluidly coupled to the manifold conduit configured to dynamically open and close in response to a weight load, wherein the firmness control comprises a pressure relief valve fluidly connected to the manifold conduit of the body support device via a conduit and configured to selectively permit a controlled amount of fluid flow out from the fluid support cells in the presence of a weight load so as to adjust a firmness property of the body support.

The disclosure may be understood more readily by reference to the following detailed description of the various features of the disclosure and the examples included therein.

BRIEF DESCRIPTION OF THE DRAWINGS SEVERAL VIEWS OF THE DRAWINGS

Referring now to the figures wherein the like elements are numbered alike:

DETAILED DESCRIPTION

Figure 1:
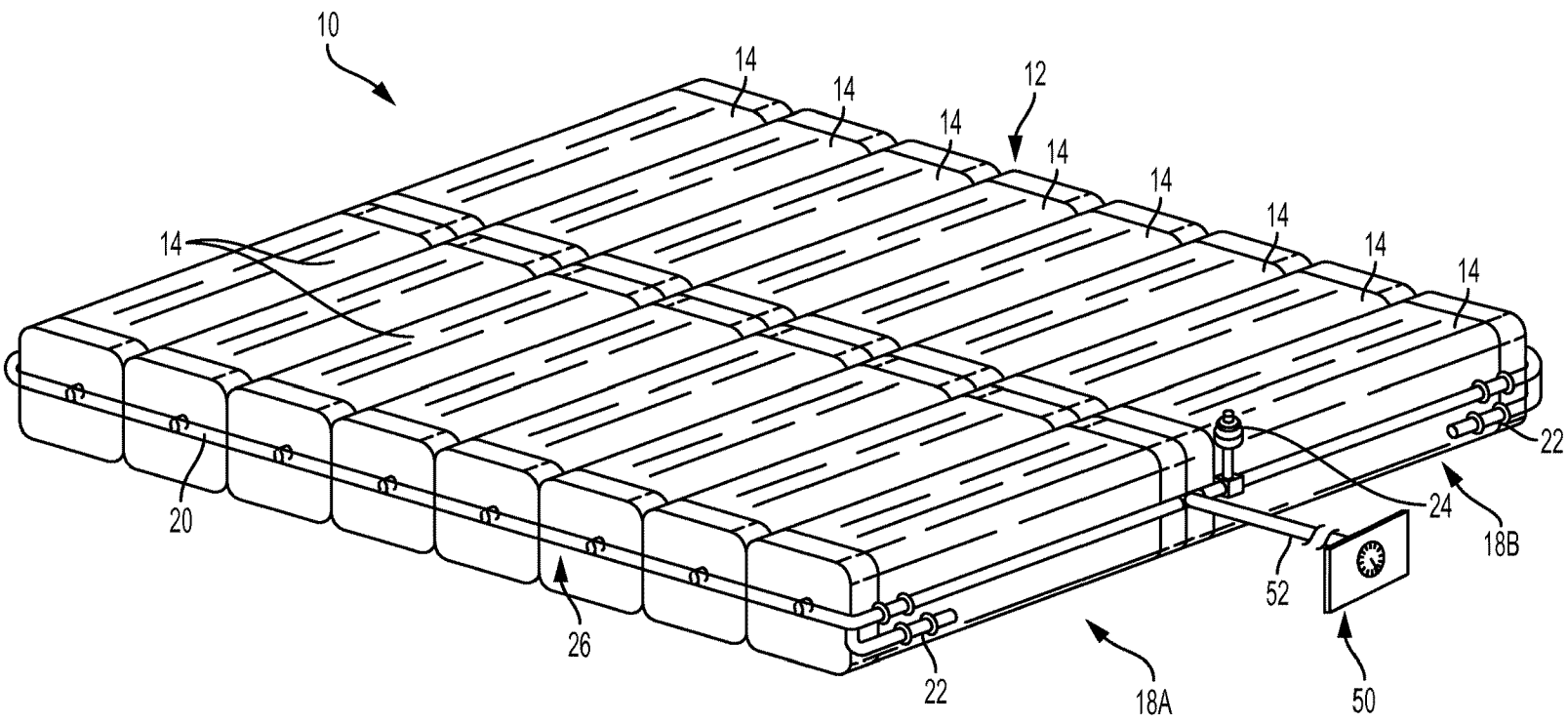
FIG. 1 illustrates a perspective view of a non-powered smart response technology body cushioning device including a firmness control for use in a mattress.

Disclosed herein are smart response technology mattresses that include selective firmness control. The mattresses generally include at least one support cell for providing lifting support for a body. Each support cell includes an envelope containing a fluid. Application of an external load on an outer surface of the envelope causes the envelope to deform into a compressed form. The envelope includes a reforming element that is capable of providing a reforming force to the interior surface of the envelope, to return the envelope to its original unloaded form. The reforming element is preferably made from a resilient foam material; however, other resilient means can be used. The present disclosure provides a firmness control for adjusting the firmness of the smart response technology mattresses.

At least one air intake valve and at least one exhaust valve are typically included in each support cell. The exhaust valve in each support cell is connected to an exhaust control system. The intake valve in each support cell is connected to an intake control system. Each intake valve may include an intake check valve allowing fluid to flow into the support cell, while preventing fluid from flowing out of the support cell. Alternatively, fluid may flow freely from one support cell to another support cell, wherein all cells in the system are controlled by a common intake and exhaust valve. Each exhaust valve can include an exhaust check valve allowing fluid to flow out of the support cell, while preventing fluid from flowing into the support cell. The intake control system is connected to a fluid supply reservoir. The exhaust control system can be connected to a fluid exhaust reservoir. Preferably, the fluid included in the supply and exhaust reservoirs is air, however, any suitable fluid, e.g., water or nitrogen, can be used. The fluid supply and exhaust reservoirs may comprise the same reservoir, and may comprise an ambient source of fluid such as atmospheric air. Alternatively, the exhaust and intake valves are in fluid communication to a manifold that is in fluid communication with the support cells. For example, the intake and exhaust valves may be disposed at the ends of the manifold. Exemplary support cells are disclosed in US Pub. No. 2008/0028534; and U.S. Pat. Nos. 7,434,283; 8,122,545; 7,617,554; 6,826,795; and 6,269,505, the disclosures of which are incorporated by reference in their entireties.

The mattresses may be of any size, including standard sizes such as a twin, queen, oversized queen, king, or California king sized mattress, as well as custom or non-standard sizes constructed to accommodate a particular user or a particular room.

The firmness control as described herein and shown in the Figures is a means to selectively adjust the firmness level by adjusting the amount of fluid within the support cell. The control generally includes a conduit in fluid communication with the support cells and an adjustable spring loaded diaphragm valve or the like disposed within the fluid conduit to selectively open and close the valve, thereby providing means to selectively adjust the firmness level. The valve may be configured for activation by use of a toggle, dial, switch, knob, and the like. In one embodiment, the firmness control is a dial.

Referring now to FIG. 1, there is illustrated a perspective view of an exemplary SRT based cushioning device 10 including the firmness control for consumer adjustment in accordance with the present disclosure. As discussed above, the SRT based cushioning device can be encapsulated in numerous other layers to define a mattress, the particular configuration is not intended to be limited to any particular layers or materials. It should also be apparent to those skilled in the art that the firmness control can be used in combination with any SRT based cushioning device where self-adjusting dynamic pressure support of a person is desired, e.g., mattress, sofa, seat, and the like. The firmness control provides a relatively quick means for adjusting a desired firmness for an end user.

The exemplary cushioning device 10 includes a non-powered fluid support system apparatus 12 comprising at least one fluid support cell 14 for providing lifting support for a user. In the illustrated exemplary embodiment, there are 16 support cells arranged in two abutting columns 18A, 18B, wherein each column includes eight support cells. Each support cell 14 is fluidly coupled to a common conduit 20. The conduit 20 includes at least one intake valve 22, two of which are depicted, and at least one exhaust valve 24, one of which is shown, to collectively define a manifold 26. The firmness control 50 is fluidly coupled to the non-powered manifold 26 via conduit 50.

Figure 2:
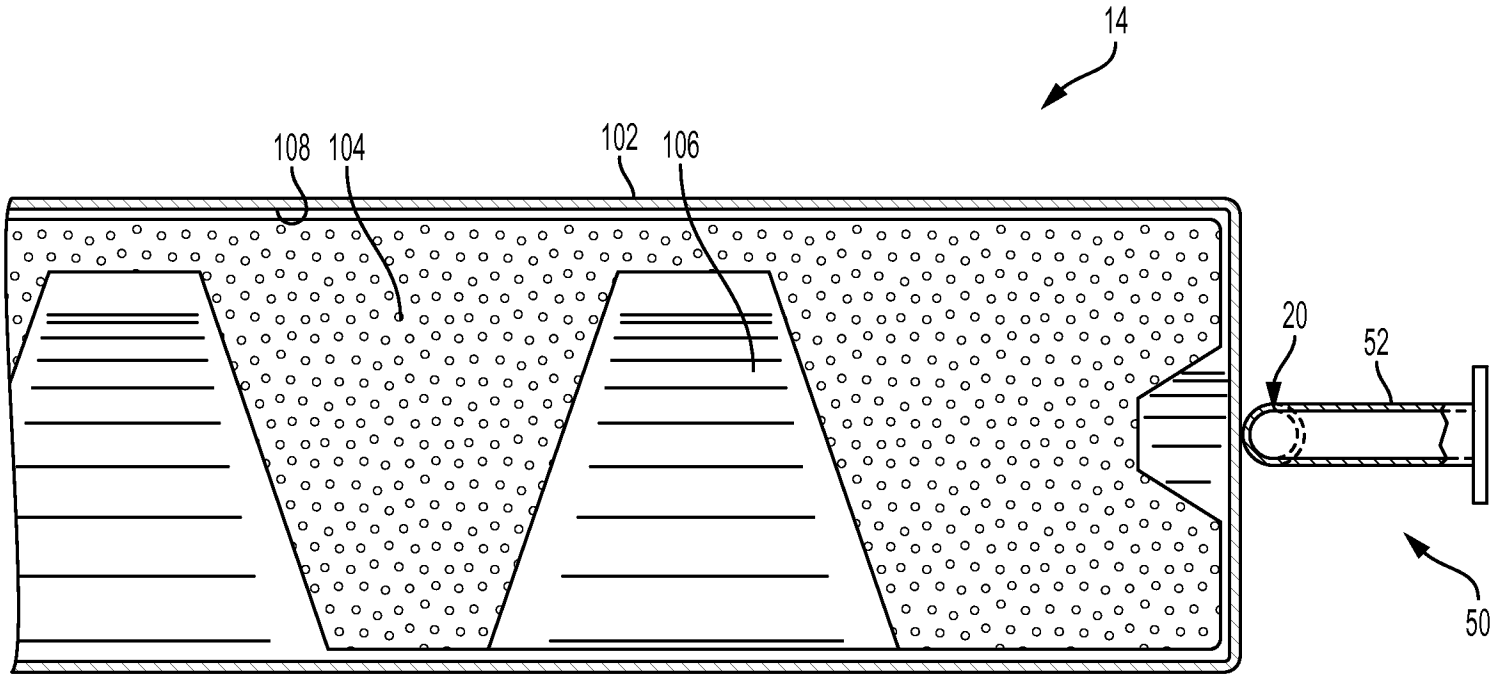
FIG. 2 illustrates a partial cross sectional view of a support cell and the accelerated calibration system of FIG. 1.

FIG. 2 illustrates an enlarged partial cross-sectional view, respectively, of the support cell 14 including the firmness control 50. Each individual support cell 14 includes an envelope 102 and a reforming element 104 disposed therein. The envelope 102 also contains a fluid 106. During use, application of an external load on the envelope 102 causes the envelope 102 to deform into a compressed form and air to be discharged into the manifold conduit 20. The reforming element 104 provides a reforming force to the interior surface 108 of the envelope 102 and causes the envelope 102 to return relatively slowly to its original form when the external load is removed from the envelope 102. The reforming element 104 can be a resilient foam material; however, other resilient materials and means can be used such as a coiled spring, bellows or the like. By way of example, the coiled spring can be surrounded by another resilient material such as a foam. The bellows may be formed from a pliable resilient material such as plastic and filled with a fluid such as air.

The firmness control 50 is fluidly connected to the non-powered manifold conduit 20 via conduit 52 and controls the firmness level desired by the consumer. The firmness control is pressure relief valve that selectively adjusts a pressure setting. Pressure is relieved by allowing pressurized fluid to flow from the support cells 14 via the manifold 20 to the conduit 52. When the pressure is exceeded, such as may occur by setting the firmness control to a soft setting, a load incurred by an end user prone on the mattress forces the valve open and a portion of the fluid contained within the fluid support system apparatus 12 is exhausted until the pressure corresponding to the soft setting is reached. In contrast, for a firmer mattress, the firmness control can be set to a firmer setting such that the valve does not open in response to a load, wherein the highest firmness setting is the nominal pressure of the smart response technology apparatus 12, which is about equal to the atmospheric pressure. In the event the mattress was previously set for a soft setting and later changed to a firm setting, the valve is open to the atmosphere to permit fluid to flow into the smart response technology apparatus 12 until equilibrium with the atmosphere is achieved. The process may the absence of a load in some embodiments. In other embodiments, if desired, an external pump can be used in combination with the firmness control to inflate the support cells to the desired firmness level in the presence of a load.

Figure 3:
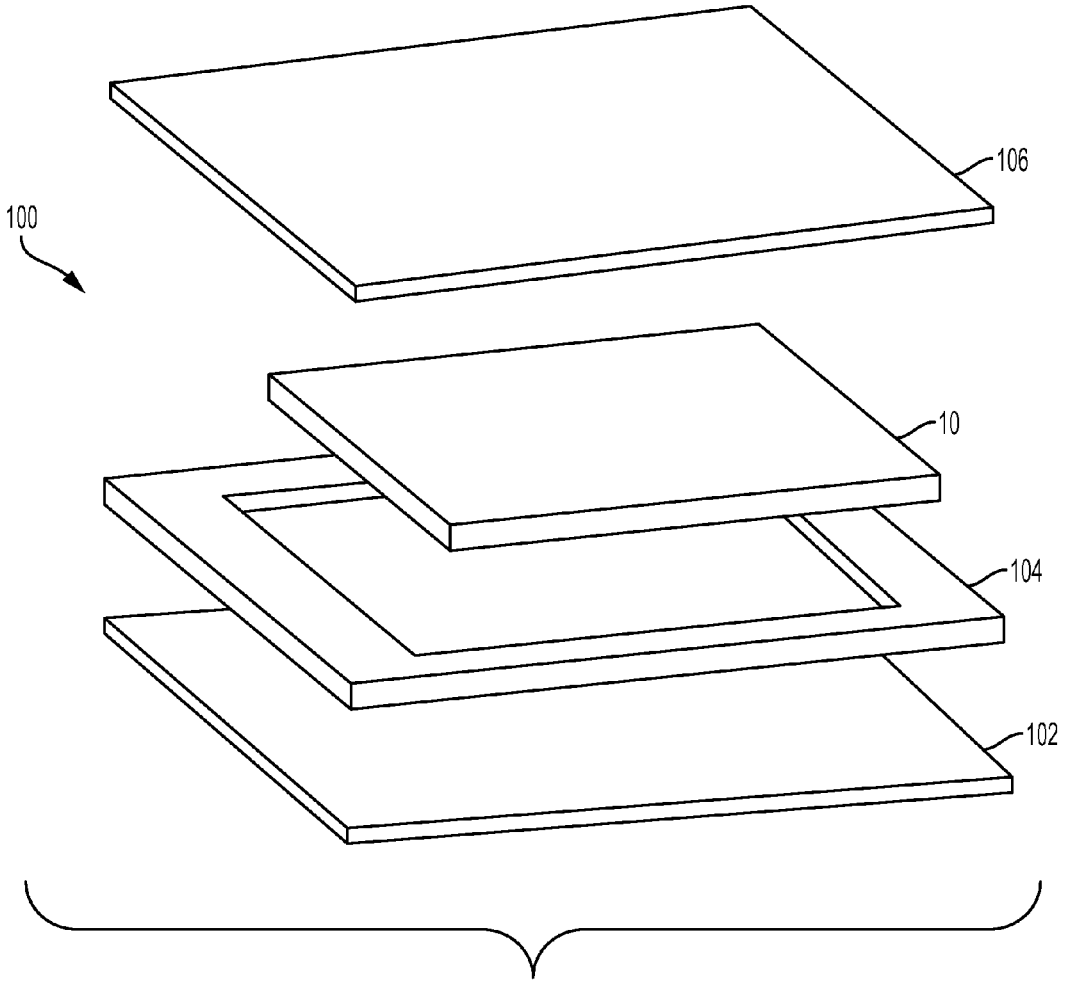
FIG. 3 illustrates an exploded perspective view of a mattress including the smart response technology body cushioning device in accordance with an embodiment of the present disclosure.

FIG. 3 illustrates an exploded perspective view of a mattress 100 including the smart response technology body cushioning device 10 in accordance with an embodiment of the present disclosure. The mattress 100 generally includes a base layer 102. In one embodiment, the base foam, layer 102 can be formed of a standard polyurethane foam layer including planar top and bottom surfaces. In one embodiment, the polyurethane foam layer is pre-stressed. Suitable pre-stressed polyurethane foams are generally formed in the manner disclosed in U.S. Pat. No. 7,690,096 to Gladney et al., incorporated herein by reference in its entirety. By way of example, a force can applied to at least a section of a standard polyurethane foam layer in an amount sufficient to temporarily compress its height so as to permanently alter a mechanical property of the foam layer to provide a pre-stressed foam layer having a firmness that is different from the firmness of a similar polyurethane foam that was not pre-stressed. The pre-stressed polyurethane foam layer is a standard polyurethane foam as noted above, typically not viscoelastic, and generally has a pre-stressed thickness of less than 1 inch to 4 inches. The density is generally less than 2.5 $lb/ft^3$ to 0.5 $lb/ft^3$ in some embodiments, and less than 2 $lb/ft^3$ to 1 $lb/ft^3$ in still other embodiments. The hardness is generally less than 60 pounds-force to 10 pounds-force in some embodiments, and less than 50 pounds-force to 30 pounds-force in still other embodiments. In one embodiment, the thickness is 2.25 inches, the hardness is 45 pounds-force, and the density is 1.5 $lb/ft^3$.

Disposed on the planar top surface of base layer 102 is a smart response technology body cushioning device 10, also referred to herein as a smart response unit, which includes one or more support cells such as described above in FIG.

1. In one embodiment, the smart response unit includes two 8-chamber support cells, wherein each one of the 8-chamber support cells are adjacent to one another and generally configured and oriented to support an individual user.

The smart response unit 10 is disposed in an opening defined by an foam edge support 104 that circumscribes the perimeter the smart response unit. The foam edge support 104 generally defines the side rail assembly for the assembled mattress. The foam edge support has a thickness of about the same or less than the thickness of the smart response unit. By way of example, the thickness of the smart response unit 10 can be 5.5 inches and the thickness of the edge support 104 can be 5.25 inches. In one embodiment, the recess is off-center lengthwise such that the smart response unit 106 is oriented more towards the head portion of the mattress. By way of example, the sides can have a width of 5.25 inches, the head end can have a width of 9 inches and the foot end can have a width of 21 inches.

In one embodiment, the foam edge support 104 is formed of a polyurethane foam having a density generally less than 3 lb/ft$^3$ and a hardness greater than 30 pounds-force. In one embodiment, the foam edge support 104 is formed of having a density of 1.65 lb/ft$^3$ and a hardness of 45 pounds-force.

In another embodiment, the foam edge support 104 is formed of open cell polyurethane foam having a non-random large cell structure or a random cellular structure with many large cells. The large cell structure can be defined by the number of cells per linear inch. In one embodiment, the large cell structure is about 10 to 40 cells per inch, with about 15 to 30 cells per inch in other embodiments, and with about 20 cells per inch in still other embodiments. The open cell foam structure includes a plurality of interconnected cells, wherein the windows between the adjacent cells are broken and/or removed. In contrast, in a closed cell foam there are substantially no interconnected cells and the windows between the adjacent cells are substantially intact. In reticulated foams, substantially all of the windows are removed. By using an open cell structure with a large open cellular structure, movement of moisture and air through a foam edge support 104 can occur. Also, if the foam edge support 104 is adhesively or thermally attached to any of the mattress layers, the skeletal struts of the open cell foam will bond to the mattress layers, thereby facilitating air and moisture transfer from the mattress layers through the side layers to the environment. In one embodiment, the foam edge support 104 includes a reticulated viscoelastic polyurethane foam.

For ease in manufacturing the mattress assembly, the foam edge support 104 may be assembled in linear sections that are joined to one another to form the perimeter about the mattress layers. The ends may be square or may be mitered depending on the manufacturing process.

An elastic conformance layer (not shown) can overlay the smart response unit 10 and the foam edge support 104.

One or more additional layers 106 can overlay the smart response unit 10 and foam edge support 104. For example, a viscoelastic polyurethane foam layer having a convoluted top surface and a planar bottom surfaces can overlay on the smart response unit 10. The viscoelastic foam layer can generally be characterized as having a thickness greater than 1 inch to about 3 inches, a density of less than 1 to 3 1 lb/ft$^3$, and a hardness of 5 to 20 pounds-force. In one embodiment, the viscoelastic polyurethane foam layer has a thickness of 2 inches, a density of about 2.1 lb/ft$^3$, and a hardness of 9 pounds-force. The convolutions are ⅜ of an inch.

The one or more additional layers 106 may include a cover panel, which may also be formed of a viscoelastic foam disposed on an underlying foam layer. The cover panel typically has planar top and bottom surfaces, a density of 1 to 5 lb/ft$^3$, a hardness of 5 to 20 pounds-force, and a thickness of 0.5 to 3 inches. In one embodiment, the cover panel has a thickness of 1 inch, a density of about 3.7 lb/ft$^3$, and a hardness of about 9.5 pounds-force.

The assembled mattress may further include mattress cover (not shown) encapsulating the various layers defining the mattress, which may be quilted or non-quilted. It should be apparent that the firmness control 50 can be coupled to the manifold 20 of the smart response unit 10 at any location via conduit 52. In some embodiments, the conduit 52 can be disposed between layers and in other embodiments, an opening may be provided in one or more of the layers to provide a desired location of the firmness control.

Figure 4:
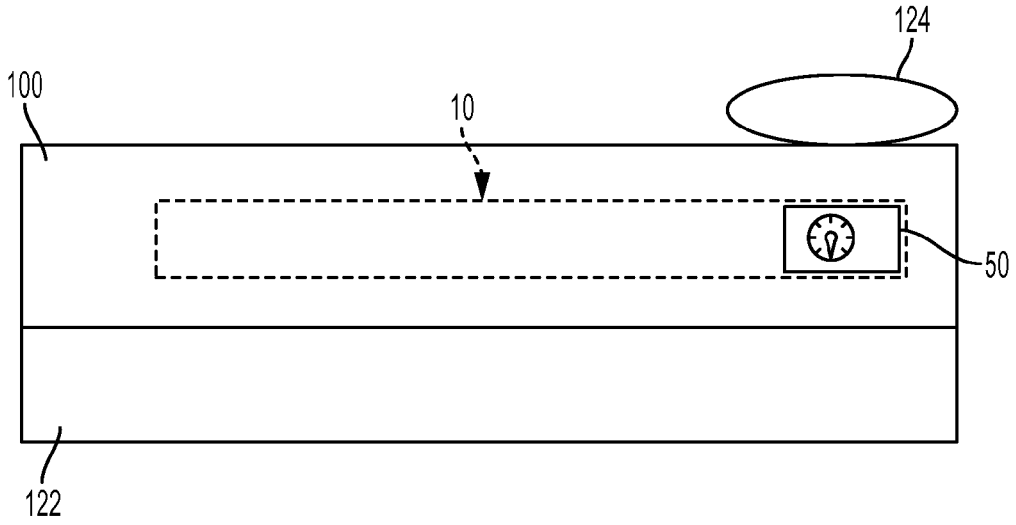
FIG. 4 illustrates an side view of a smart response technology mattress and in accordance including the firmness control in accordance with an embodiment of the present disclosure.

In one embodiment shown in FIG. 4, the firmness control valve 50 is integrated into a side of the smart response technology mattress 100, which includes the non-powered smart response unit 10, wherein adjustment of the firmness control valve is controlled by a dial. In this embodiment, the firmness control 110 can embedded within a side rail assembly (e.g., layer 104 of FIG. 3) that circumscribes a perimeter of the support cells defining the smart response technology mattress 100. The mattress 100 is overlays a foundation 122. In the embodiment shown, the firmness control is disposed at about the head portion of the mattress, i.e., where the end user would typically rest their head on a pillow 124.

Figure 5:
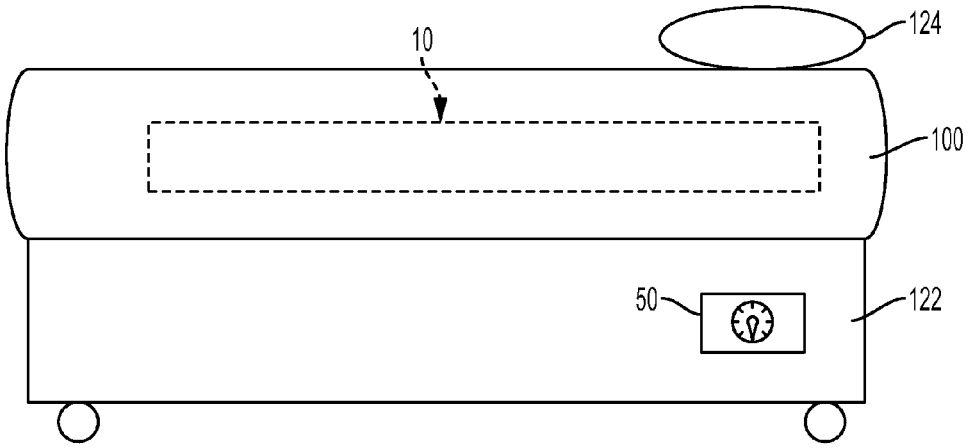
FIG. 5 illustrates an side view of a smart response technology mattress in accordance including the firmness control in accordance with another embodiment of the present disclosure.

In another embodiment, the firmness control is embedded within the foundation 122, which supports the smart response technology mattress 100 including the smart response support unit 10 as shown in FIG. 5. As shown, a dial is recessed into a side of the foundation. In one embodiment, the firmness control is disposed into a side defined by a length of the mattress. In other embodiments, the firmness control is disposed at the head end or the foot end. The conduit 52 may include a quick disconnect for connecting an open end of the conduit fluidly coupled to the firmness control valve with the open end of the conduit fluidly coupled to the manifold 20 of the smart response unit 10 in the mattress 10. The conduit 52 can be connected at about an interface between a bottom surface of the mattress and a top surface of the foundation. By way of example, the portion of the conduit 52 in fluid communication with the support cell can exit the bottom of the mattress assembly through a fold in a bottom panel to allow fire retardant protection to be applied to any exterior surfaces.

Figure 6:
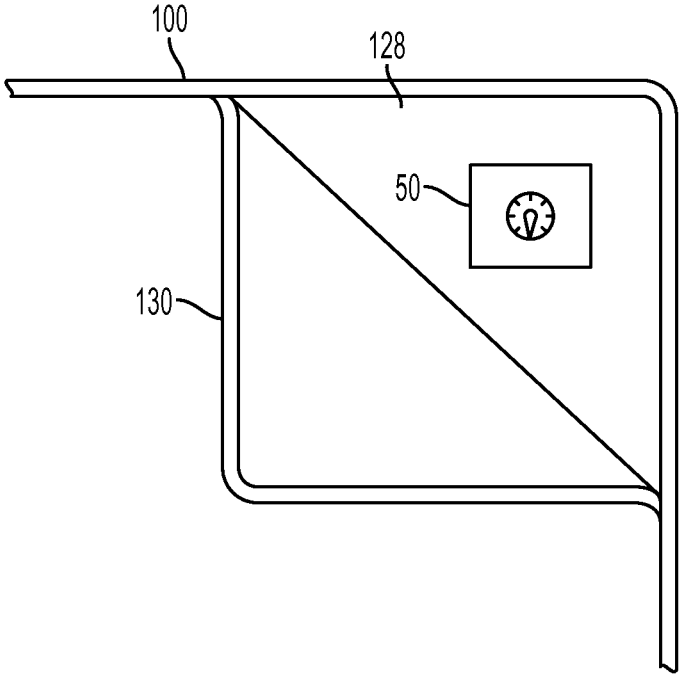
FIG. 6 illustrates an enlarged bottom view depicting a corner of a smart response technology mattress including the firmness control in accordance with still another embodiment of the present disclosure.

In yet another embodiment shown in FIG. 6, the firmness control 50 would be located on a bottom surface 128 of the mattress. The firmness control 50 would be out of sight from the end user and require remaking of the mattress cover sheets after every adjustment since the mattress 100 would need to be manipulated to gain access to the firmness control. As shown, the mattress 100 may include a zippered bottom panel than can be unzipped to provide access to the firmness control.

Figure 7:
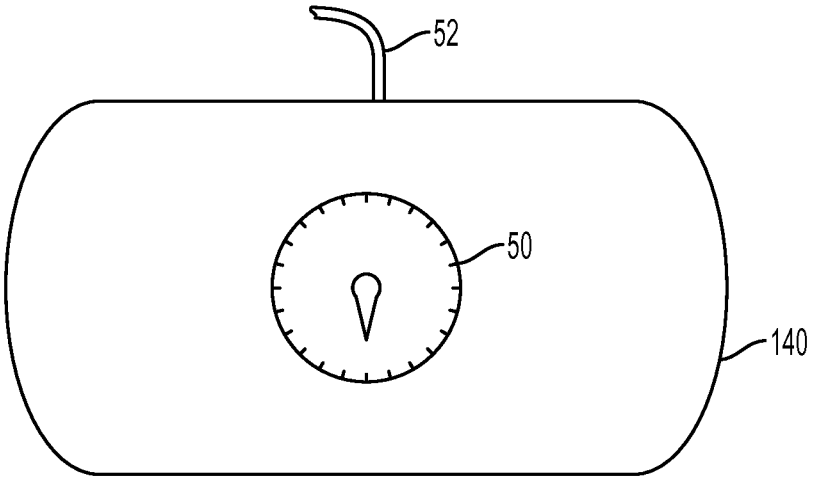
FIG. 7 illustrates a front facing view of an external firmness control for use with the smart response technology mattress of the present disclosure.

Referring now to FIG. 7, in another embodiment, the firmness control may be contained within a housing 140 and externally located from the mattress, e.g., mattress 100, including the smart response unit 10 and foundation, e.g., foundation 122. For example, the firmness control 50 may connected to the manifold of eh smart response unit of the mattress via a quick connect fitting such as was previously described. In this manner, the firmness control could be used with any foundation, and would allow placement determination by the consumer.

Still other embodiments include increasing the ILD of the foam within the support cell. In the original design the ILD of the foam in the bladder allowed the person on the bed to continue to vent the bed until the foam had fully collapsed. This would form a huge cavity when you got up off of the bed. Normally a 24 ILD foam is used for soft and a 33 ILD foam for firm. If we used 22 ILD in the bladder and used the air as a firmness assist to simulate the 33 ILD. That way you would only deflate to where the 24 ILD foam is fully supporting you. The firmer foam you prevent them from sinking in 2, 3 or 4 inches into the bladder. When the bladder is fully inflated you would see very little deflection. Fully deflated you would probably only go about an inch into the bladder. That probably would be noticeable when you got off the bed. This would allow the consumer to dial in their preference and keep it.

Other embodiments include adding an auto-inflation valve. That way the bed will start firm every time and the consumer can feel the bed soften. A simple valve can be placed on the rail behind the cover and sock.

Optionally, the SRT mattress can be dimensioned to be used as a lumbar support. The same type of valve on each side of the bed to allow each sleeper to adjust their own lumbar support separately. Since the size is much smaller it should reduce to a manageable level any depressions in the mattress. An end user would simply need to press the button when exiting the mattress so as to inflate the lumbar support, i.e., insert. Once on the mattress, the end user would push on the button to release air to adjust the firmness to a desired setting. Once the end user is at the desired level, it would stay that way until adjusted again.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A self-adjusting, non-powered smart response technology mattress comprising:

a self-adjusting, non-powered body support device consisting of:

a plurality of fluid support cells, wherein each fluid support cell includes an envelope and a reforming element disposed within the envelope; and a non-powered manifold system including a manifold conduit fluidly and directly coupled to the plurality of fluid support cells, and intake and exhaust valves fluidly coupled to the manifold conduit configured to dynamically open and close in response to a weight load to permit fluid to simultaneously flow out of the plurality of fluid support cells directly coupled to the manifold, wherein the intake and exhaust valves are fluidly coupled to an atmospheric environment of the mattress;

one or more layers overlaying the body support device and a side rail assembly circumscribing a perimeter of the body support device; and a firmness control independent from the intake and exhaust valves externally accessible on an exterior surface of the non-powered smart response technology mattress by an end user during use comprising a two way pressure relief valve fluidly and directly connected to the manifold conduit of the body support device via a firmness control conduit and configured to selectively permit a controlled amount of fluid flow out from the fluid support cells into an external environment in the presence of the weight load during use thereof so as to adjust a firmness property of the body support and selectively permit a controlled amount of fluid to freely flow into all of the fluid support cells from the external environment in an absence of the weight load, wherein the firmness property is highest at a nominal pressure of the body support device in the absence of the weight load, wherein the nominal pressure is equal to atmospheric pressure of the external environment and wherein the firmness control is configured to decrease the firmness property in the presence of the weight load.

2. The mattress of claim 1, wherein the pressure relief valve is a spring loaded diaphragm valve.

3. The mattress of claim 2, wherein the firmness control comprises a movable dial and gauge coupled to the pressure relief valve for selecting a desired firmness level, wherein the movable dial is configured to adjust the firmness level by adjusting a spring load.

4. The mattress of claim 1, wherein the reforming element is a foam body and is encapsulated in an envelope.

5. The mattress of claim 1, wherein the pressure relief valve is coupled to a spring loaded button configured to open and close the valve.

6. The mattress of claim 1, wherein the reforming element is a coil encased in a foam body.

7. The mattress of claim 1, wherein the reforming element is a bellows.

8. The mattress of claim 1, wherein the fluid in the fluid support cells is air.

9. The mattress of claim 1, wherein the firmness control is embedded within the side rail assembly and the conduit extends from the manifold conduit to the firmness control.

10. The mattress of claim 1, wherein the firmness control is embedded within a sidewall of a foundation supporting the mattress and the conduit extends from the manifold conduit through a bottom surface of the mattress to the firmness control.

11. The mattress of claim 10, wherein the conduit comprises a first portion extending from the manifold conduit to the bottom surface of the mattress; a second portion extending from the firmness control to a top surface of the foundation; and a connector for connecting the first portion to the second portion.

12. The mattress of claim 1, wherein the firmness control is embedded within a bottom surface of the mattress.

13. The mattress of claim 1, wherein the conduit comprises a first portion extending from the manifold conduit to an external surface of the mattress; a second portion extending from the firmness control; and a connector for connecting the first portion to the second portion.

* * * * *